US007655062B2

(12) United States Patent
Greene

(10) Patent No.: US 7,655,062 B2
(45) Date of Patent: Feb. 2, 2010

(54) FILTER ASSEMBLY FOR A VACUUM CLEANER

(75) Inventor: Mason Greene, Auburn, AL (US)

(73) Assignee: Euro-Pro Operating, LLC, West Newton, MA (US)

( * ) Notice: Subject to any disclaimer, the term of this patent is extended or adjusted under 35 U.S.C. 154(b) by 351 days.

(21) Appl. No.: 11/056,085

(22) Filed: Feb. 10, 2005

(65) Prior Publication Data

US 2006/0174597 A1 Aug. 10, 2006

(51) Int. Cl.
*B01D 46/00* (2006.01)

(52) U.S. Cl. ..... 55/482; 55/486; 55/521; 55/498; 55/DIG. 3

(58) Field of Classification Search ..... 55/337, 55/357, 471, 486, 498, 521, DIG. 3, 485, 55/487, 444, 446, 482, 500, 529, 488, 489; 95/273, 281, 287; 96/55, 58, 61, 63, 231, 96/286; 15/353, 347, 352; 210/483, 487, 210/488, 489, 493.1–493.5
See application file for complete search history.

(56) References Cited

U.S. PATENT DOCUMENTS

| | | | | | |
|---|---|---|---|---|---|
| 4,726,825 | A * | 2/1988 | Natale | 55/318 |
| 5,248,323 | A * | 9/1993 | Stevenson | 95/90 |
| 5,288,298 | A * | 2/1994 | Aston | 96/135 |
| 5,651,811 | A * | 7/1997 | Frey et al. | 96/69 |
| 5,858,044 | A * | 1/1999 | Nepsund et al. | 55/486 |
| 6,007,608 | A * | 12/1999 | Johnson | 95/287 |
| 6,015,452 | A * | 1/2000 | Nepsund et al. | 95/287 |
| 6,036,738 | A * | 3/2000 | Shanbrom | 55/524 |
| 6,142,411 | A | 11/2000 | Cobleigh | |
| 6,171,375 | B1 * | 1/2001 | Howie | 96/17 |
| 6,197,096 | B1 * | 3/2001 | Cartellone | 96/55 |
| 6,585,793 | B2 * | 7/2003 | Richerson et al. | 55/521 |
| 6,709,495 | B1 | 3/2004 | Storer | |
| 6,790,397 | B2 * | 9/2004 | Richerson et al. | 264/154 |
| 6,866,693 | B2 * | 3/2005 | Igarashi | 55/385.3 |
| 6,942,708 | B2 * | 9/2005 | Peter et al. | 55/282.3 |
| 7,144,438 | B2 * | 12/2006 | Lee et al. | 55/429 |
| 2003/0182909 | A1 * | 10/2003 | Gieseke et al. | 55/385.3 |
| 2004/0187455 | A1 * | 9/2004 | Niakan et al. | 55/486 |
| 2005/0223520 | A1 * | 10/2005 | Greene et al. | 15/353 |
| 2006/0090431 | A1 * | 5/2006 | Brown | 55/482 |
| 2007/0175193 | A1 * | 8/2007 | Niakan | 55/487 |

FOREIGN PATENT DOCUMENTS

| | | |
|---|---|---|
| EP | 0 583 972 A1 | 2/1994 |
| GB | 2 211 371 A | 6/1989 |

* cited by examiner

*Primary Examiner*—Duane Smith
*Assistant Examiner*—Minh-Chau T Pham
(74) *Attorney, Agent, or Firm*—McCarter & English, LLP; Michael I. Wolfson

(57) ABSTRACT

A filter assembly for a vacuum cleaner including a filter cartridge a first substantially rigid pleated filter element having a plurality of pleats with pleated edge and a flexible pre-filter element positioned over the pleated edge of the filter cartridge. The pleats may be radial, longitudinal or conical with the pre-filter a disc, cylinder or frusto-conical in shape. In each case the pre-filter is positioned on the pleats so that dirt laden air is drawn through the pre-filter element and then through the pleated filter element before being drawn into a vacuum motor

5 Claims, 5 Drawing Sheets

FILTER ASSEMBLY FOR A VACUUM CLEANER

BACKGROUND OF THE INVENTION

The invention relates generally to filters for vacuum cleaners, and more particularly to a filter assembly that includes a filter cartridge having a fixed element and a pre-filter that improves removal of dust particles before the air stream enters the vacuum motor.

Vacuum cleaners are well known and a common household appliance. Most vacuum cleaners include some type of filter, often held in a filter cartridge. Filter cartridges are used to entrain dust before the air stream reaches the motor to prolong and protect the life of the vacuum cleaner motor. Some filter cartridges contain one filter whereas other filter cartridges have two or three filters arranged in series in order to extract as much dirt as possible from the air flowing to the vacuum motor.

There are many different types of filter known in the art that are used in filter cartridges, such as HEPA filters, foam filters, electrostatic filters and the like.

Notwithstanding the wide variety of filters cartridge available for use in vacuums cleaners, there exists the need to provide continued improvements and alternative designs to improve vacuum cleaner filter cartridge performance by providing a pre-filter that are economical to use, simple in design and easy for the user to operate.

SUMMARY OF THE INVENTION

Generally speaking, in accordance with the invention, a filter assembly for a vacuum cleaner including a vacuum cleaner filter cartridge with a first substantially rigid pleated filter element and a flexible pre-filter element positioned over the folded edges of the pleats of the first filter element is provided. In the case of a first pleated element including radial pleats, the pre-filter element is a disk that covers the pleats to entering air. When the first pleated element includes axial pleats forming a cylindrical or a conical section, the pre-filter is a cylindrical or a conical section that fits over the cartridge so that air entering the side of the cartridge passes through the pre-filter before reaching the pleats of the first filter element.

Accordingly, it is an object of the invention to provide an improved filter assembly in a vacuum cleaner.

Another object of the invention is to provide an improved vacuum cleaner with a pre-filter positioned in front of the open pleats of a pleated filter in the filter cartridge.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is had to the following description taken in connection with the accompanying drawing(s), in which.

DETAILED DESCRIPTION OF THE INVENTION

Figure 1A:
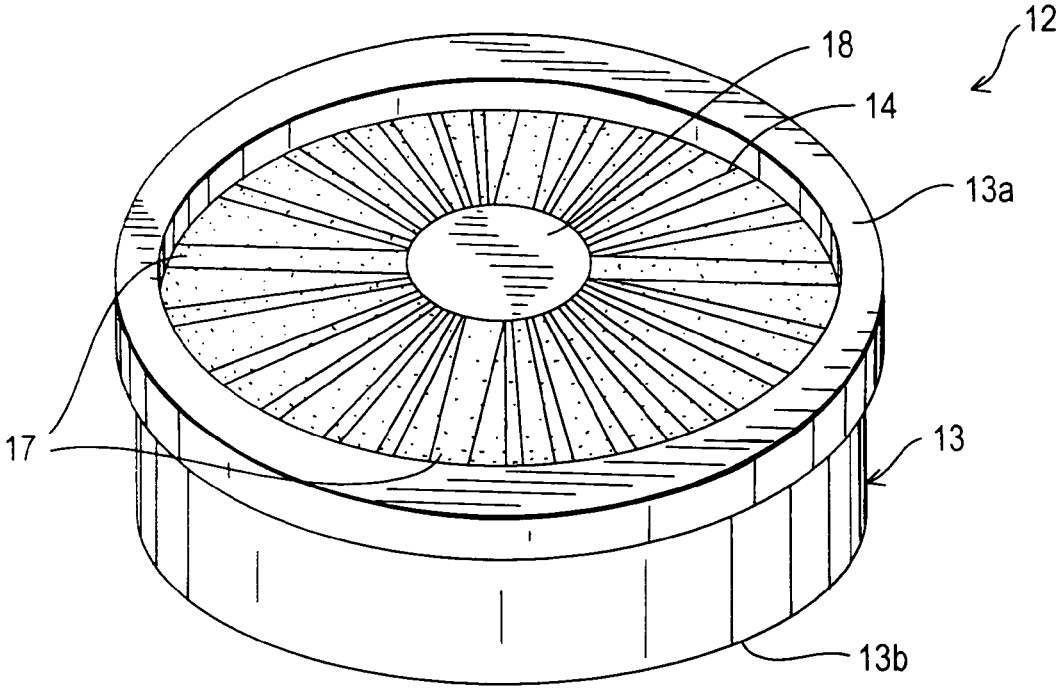
FIG. 1A is a bottom perspective view of a filter cartridge with a substantially rigid filter element having radial pleats.
Figure 1B:
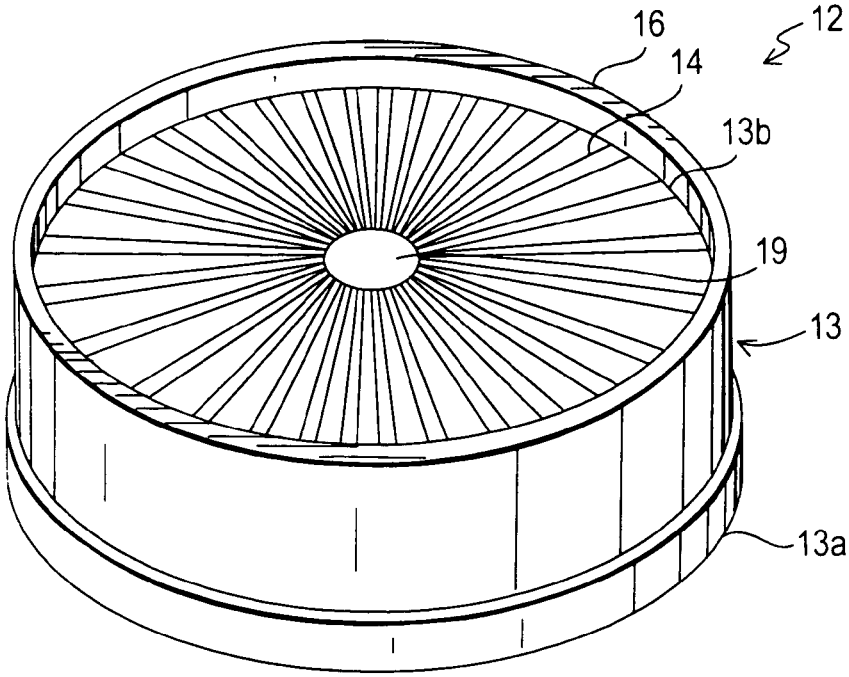
FIG. 1B is a top perspective view of the filter cartridge of FIG. 1.

FIGS. 1A and 1B are bottom and top perspective views of a filter cartridge 12 with radial pleats, respectively. Filter cartridge 12 includes a cylindrical shell or sidewall 13 having an open top 13*b* and an open bottom 13*a* with a pleated filter medium 14 fixed therein. Pleated filter medium 14 has a plurality of radially extending pleats 14*a*. Open bottom 13*a* of filter cartridge 12 has a pair of cross-hatch beams 17 to provide support and hold a center pin 18 with an upper button 19 for securing pleated filter element 14 in place. Top 13*b* of sidewall 13 has an extending edge 16 for positioning a pre-filter element 21 as shown in FIG. 2.

Figure 2:
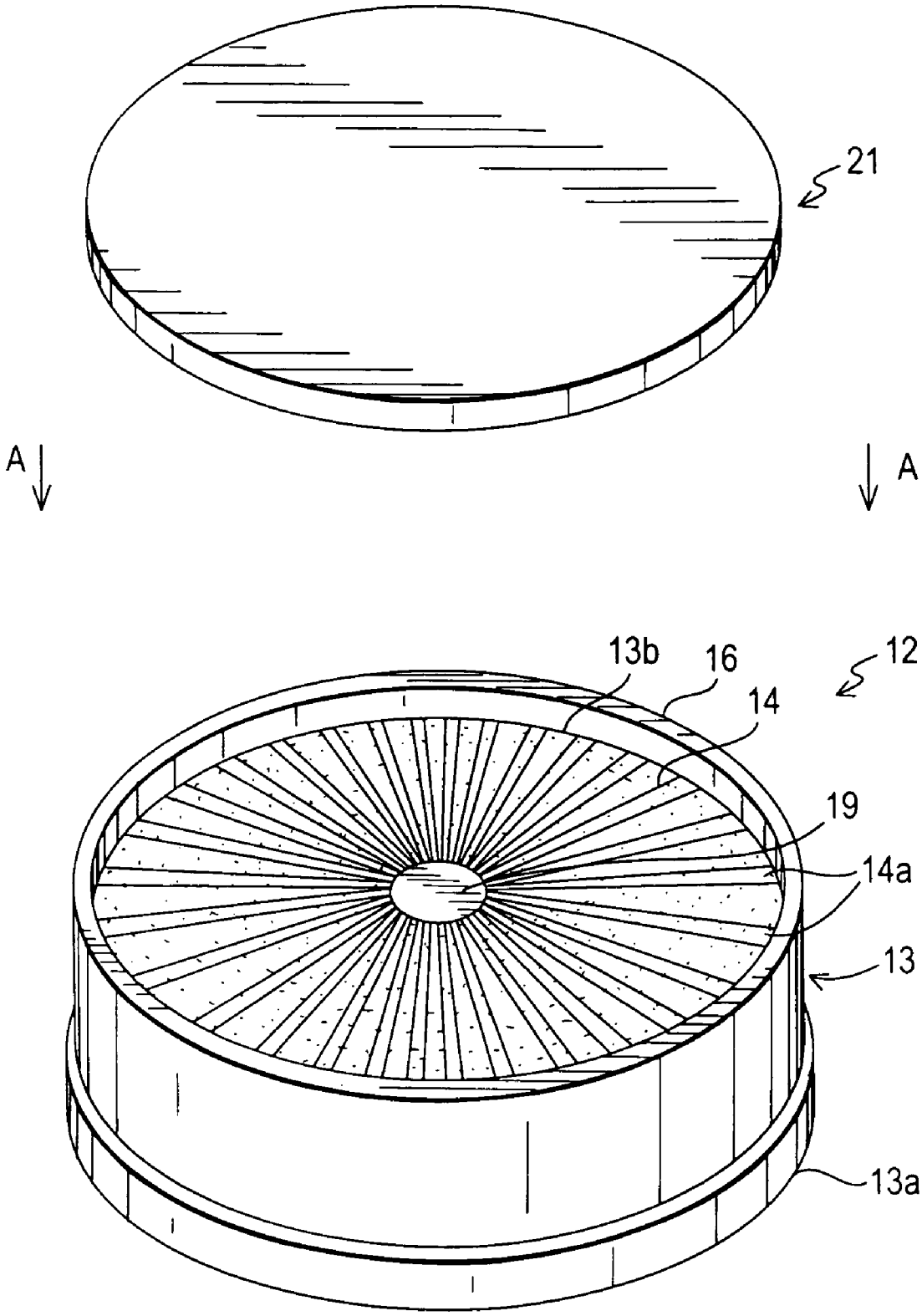
FIG. 2 is an exploded perspective view of a filter assembly of FIGS. 1A and 1B and a disk-shaped pre-filter element in accordance with the invention.

FIG. 2 is an exploded view of a filter assembly 11 that includes filter cartridge 12 with radial pleats 14*a* and disk-shaped pre-filter element 21. Pre-filter 21 is disk shaped and is positioned in front of open top 13*b* of filter cartridge 12. Here, arrows A show how disk-shaped pre-filter 21 is positioned in relation to filter cartridge 12 to create filter assembly 11. Filter pleats 14*a* are radially disposed to increase the filtering surface area, before the clean air is drawn into the motor. Alternatively, depending on the direction of air flow, pre-filter 21 may be positioned in front of open bottom 13*a* of filter cartridge 12.

Filter 14 may be a high density polyethylene-based open-celled porous media, such as Porex, or an equivalent foraminous filter. The filter media may also be made from glass fibers, cellulose fibers, ceramic fibers, metal fibers, synthetic material and the like. A suitable filter media is a rigid open-celled foam that is moldable or washable into a desired configurations. Preferably, filter 14 is a high efficiency particular arrest (HEPA) filter element in radial pleated form within cartridge 12. Filter cartridge 12 is about 60 cm to 110 cm in diameter and 2.5 cm to 7.5 cm in length. The illustrated embodiment shows a filter cartridge 12 having 9.5 cm in diameter by 3.5 cm in length.

Figure 3:
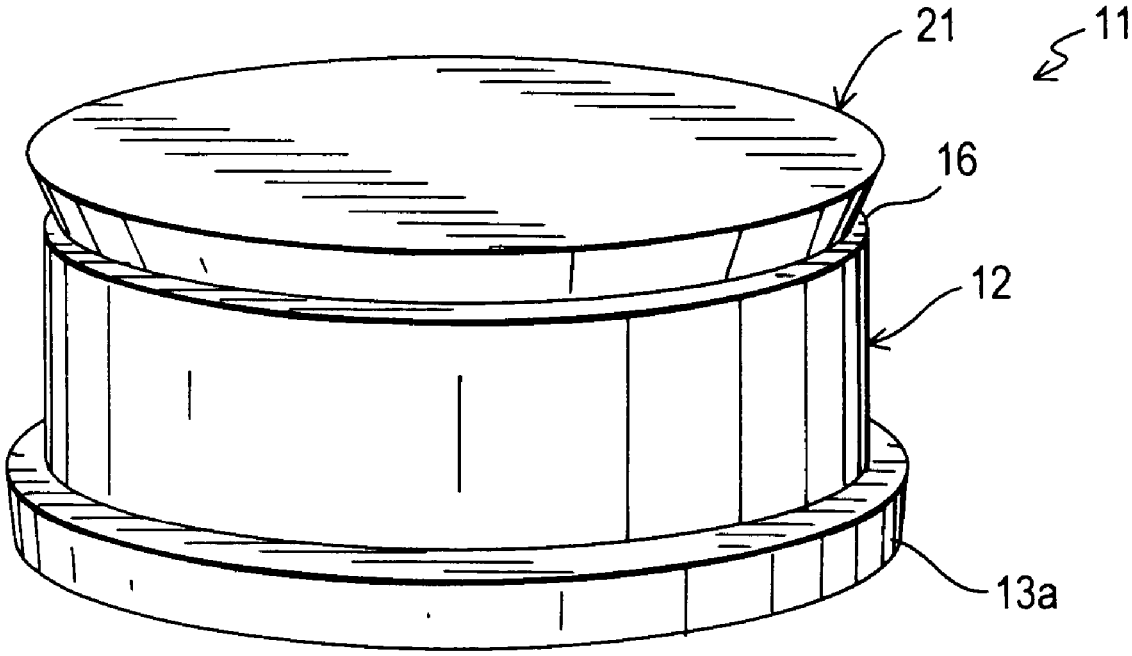
FIG. 3 is a perspective view of the assembled filter assembly of FIG. 2 with the pre-filter in place.

FIG. 3 a perspective view of filter assembly 11 of FIG. 2. Pre-filter 21 is placed in contact with filter cartridge 12 in a vacuum cleaner so the dirt-laden air passes through pre-filter 21 before passing through pleated filter 14 in filter cartridge 12 prior to entering a vacuum motor.

As shown in FIGS. 2 and 3, filter assembly 11 is arranged so that pleated filter 14 is secured in filter cartridge 12 such that pleated filter 14 is positioned directly adjacent to cross-hatch beams 17. Pre-filter 21 is positioned facing open top 13*b* of filter cartridge 12 such that pre-filter 21 faces pleats 14*a* of pleated filter 14.

Filter assembly 11 is positioned in the air flow path of a vacuum cleaner, such as a bagless cyclonic vacuum. Filter assembly 11 is arranged so that air exiting the cyclonic air separation chamber or dirt cup passes through pre-filter 21 first. This is where the initial filtration happens. Here, a majority of any remaining larger dirt or dust particles are retained in pre-filter 21. Pre-filter 21 may be removed from the vacuum cleaner for washing and reuse. Dirt or dust laden air then proceeds downstream to enter filter cartridge 12 which contains pleated filter 14. Any remaining dirt or dust is retained in pleated filter 14. Use of pre-filter 21 protects and prolongs the life of pleated filter 14, which is preferably a HEPA grade filter. In the instance when filter assembly 11 is full with dirt or dust, the vacuum motor is still protected. A filter indicator and/or safety valve on a vacuum cleaner may be provided to activate or open when a rise in temperature or back pressure across the filter assembly occurs.

In another embodiment of the invention, a cylindrical filter cartridge 32 includes a circular shell of plastic material top 33 and bottom 34 with a pleated filter medium 36 having a plurality of pleats 36*a* fixed therein. Top shell 33 has a larger diameter than the bottom shell 34. Bottom shell 34 has an inner circular opening 37 that corresponds to pleated filter 36 with a pair of cross-hatch beams 38 disposed across an outlet opening 39. The filter pleats 36*a* are axially disposed to increase the filtering surface area, before the clean air is drawn into the motor.

Figure 4:
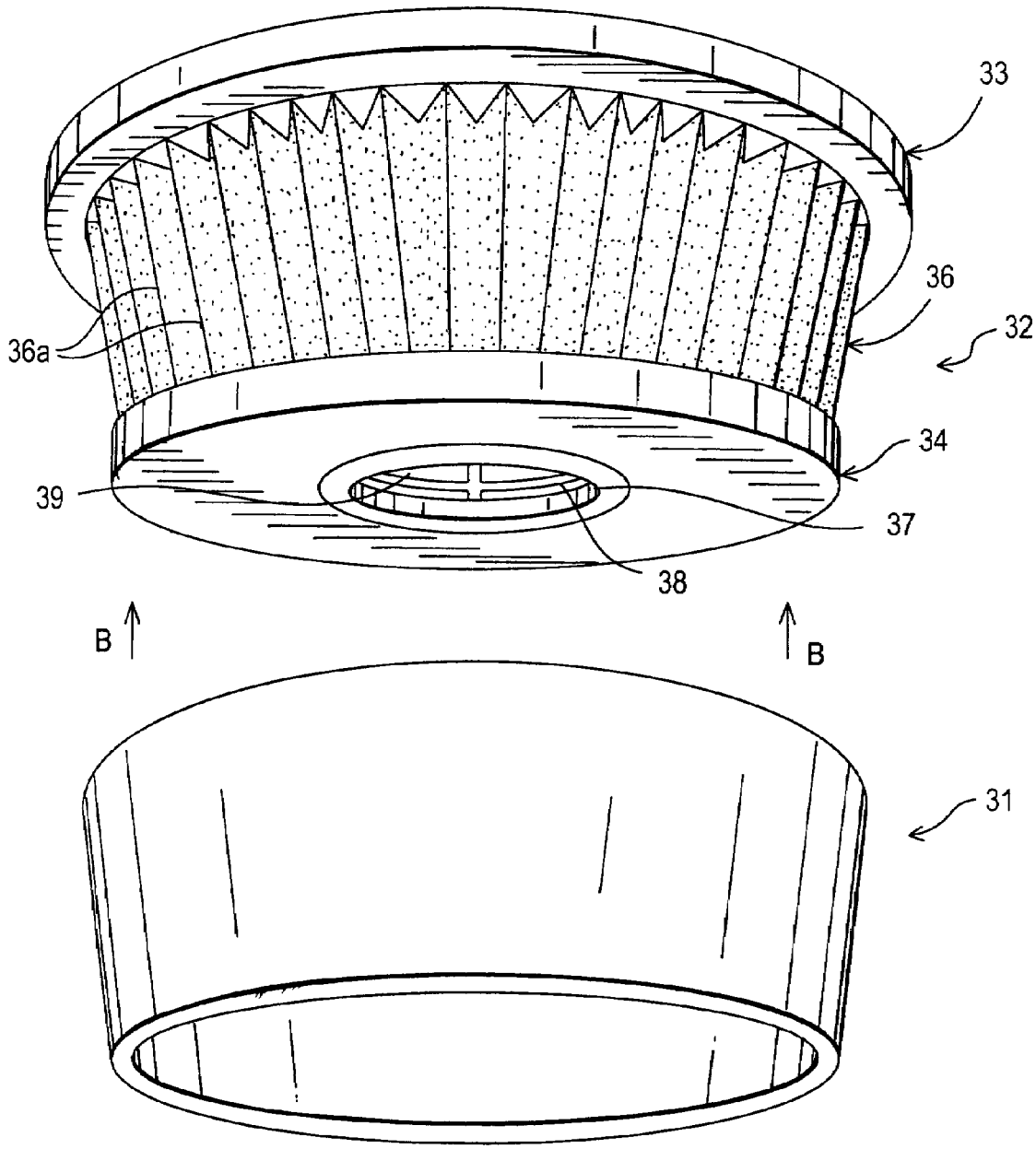
FIG. 4 is an exploded perspective view of a filter assembly that includes a cylindrical filter cartridge with a substantially rigid filter element having longitudinal pleats and a cylindrical pre-filter element in accordance with the invention.

FIG. 4 shows an exploded view of a filter cartridge 32 with axial pleats forming a cylinder shape and pre-filter 31. Here, pre-filter 31 is in a shape that fits over filter cartridge 32 so that air entering the side of filter cartridge 32 passes through pre-filter 31 first before reaching filter cartridge 32. Here, air exits through outlet 39 of filter cartridge 32 before reaching the motor. Arrows B in FIG. 4 show how the cylinder-shaped pre-filter 21 is positioned in relation to filter cartridge 22 to create a filter assembly.

Figure 5:
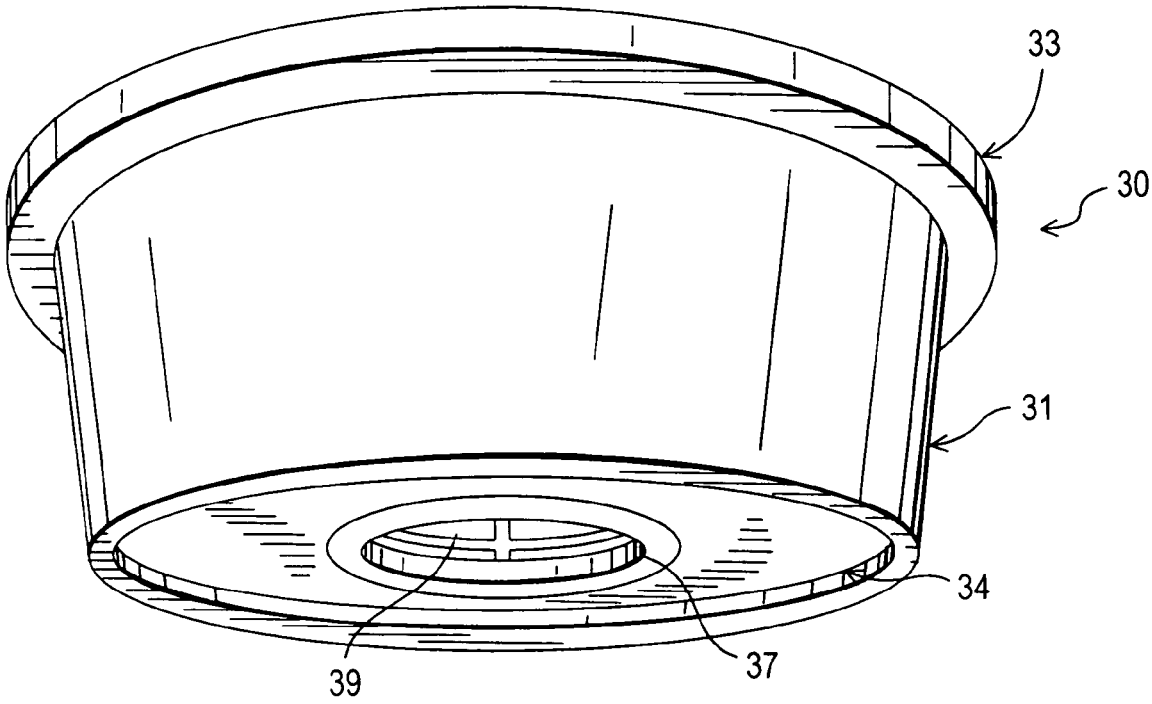
FIG. 5 is a perspective view of the assembled filter assembly of FIG. 4 with the pre-filter in place.

FIG. 5 is a perspective view of filter assembly 30 of FIG. 4. Pre-filter 31 is placed in a vacuum cleaner so that the dirt-laden air passes through pre-filter 31 before passing through the pleated filter 36 in the filter cartridge before entering a vacuum motor.

As shown in FIGS. 4 and 5, the filter assembly is arranged so that pleated filter 36 is contained in filter cartridge 32 such that pleated filter 36 is positioned between top shell 33 and bottom shell 34 of filter cartridge 32 and then pre-filter 31 is position directly adjacent and around the circumference of filter cartridge 32 such that pre-filter 31 lies on pleats 36*a* of pleated filter 36.

According to the invention, pre-filters 21 and 31 may be selected from a variety of different types of filter materials depending on the needs of the user. Pre-filters 21 and 31 may be made from open cell polyurethane foam or non-woven polyester. Since pre-filters 21 and 31 will generally retain most of the dust or dirt entrained in the air flow, it is preferable that pre-filters 21 and 31 be washable. For pre-filter 21, the outer diameter is at least the same diameter as pleated filter 14, which is discussed below and has a thickness from about 0.25 cm to about 2 cm. Preferably, the outer diameter of pre-filter 21 is slightly larger than the diameter of cylindrical sidewall 21 of filter cartridge. In the illustrated embodiment, pre-filters 21 and 31 are a non-woven polyester material.

The approximate dimensions of the filter cartridges are from about 60 cm to 110 cm in diameter and from about 2.5 cm to 7.5 cm in length. The illustrated embodiments are 9.5 cm in diameter and 3.5 cm in length. The actual size of the filter assemblies will be dependent on the vacuum cleaner housing and dirt cup in which the cartridges will fit.

Filter assembly 30 is positioned in the air flow path of a vacuum cleaner. Filter assembly 30 is arranged so that the dust or dirt laden air exiting a cyclonic separation chamber enters pre-filter 31 first. This is where the initial filtration happens. Here, a majority of the remaining larger dirt or dust particles are retained in pre-filter 31 that may be easily removed from the vacuum cleaner and washed. Then, the air passes through pleated filter 36 with any remaining dirt or dust being retained in pleated filter 36. Here, clean air exits out of outlet 39 in bottom shell 34 and travels to the vacuum motor. This filter assembly 30 effectively removes any dirt not separated and collected in the air separation chamber and prolongs the life of the vacuum motor.

In general, when using a filter assembly 11 or 30 in vacuum cleaners substantially all of the dirt and/or dust that enters the filter assembly is retained in pre-filters 21 and 31 so that minimal dirt and/or dust is retain in the pleated filter, which is prefereably a HEPA grade filter, of the vacuum cleaner filter cartridge. This is due to the fact that pre-filter has the capability to retain a large amount of dirt.

In another embodiment of the invention, pre-filter may be in any shape depending on the shape of the filter cartridge i.e. disk shape, cylinder shape, frusto-conical shape, etc. Pre-filter is positioned in on the inlet face of the filter cartridge against the filter pleats that has an increase filtering surface area, before the clean air is drawn into the motor. The filter pleats may be disposed radially or axially depending on the type of filter cartridge used.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention.

What is claimed is:

1. A filter assembly for a vacuum cleaner comprising:

a substantially cylindrical filter housing with an open inlet end and an open outlet end;

a first substantially rigid radially pleated filter element extending from the axis of the housing to the housing wall with a plurality of pleats with pleated edges extending from the edge of the inlet end to the outlet end of the housing; and a disc-shaped flexible pre-filter element positioned on the edge of and outside the inlet end of the housing and in contact with the pleated edges of the pleated filter element disposed in the cylindrical housing.

2. The filter assembly for a vacuum cleaner of claim 1, wherein the pre-filter is a non-woven polyester material.

3. The filter assembly for a vacuum cleaner of claim 1, wherein the pre-filter is a foam material.

4. The filter assembly for a vacuum cleaner of claim 1, wherein the pre-filter is washable.

5. The filter assembly for a vacuum cleaner of claim 1, wherein the housing is substantially cylindrical in shape.

* * * * *